US010287662B2

(12) United States Patent
Shiota et al.

(10) Patent No.: US 10,287,662 B2
(45) Date of Patent: May 14, 2019

(54) ALUMINUM ALLOY CAST PRODUCT AND METHOD FOR PRODUCING THE SAME

(71) Applicants: HONDA MOTOR CO., LTD., Tokyo (JP); S.S.ALUMINUM CO., LTD., Osaka-shi, Osaka (JP)

(72) Inventors: Tomoki Shiota, Wako (JP); Nobuhiro Ishizaka, Chofu (JP); Satoshi Kato, Chiba (JP)

(73) Assignees: HONDA MOTOR CO., LTD., Tokyo (JP); S. S. ALUMINUM CO., LTD., Osaka-Shi (JP)

( * ) Notice: Subject to any disclaimer, the term of this patent is extended or adjusted under 35 U.S.C. 154(b) by 499 days.

(21) Appl. No.: 14/607,377

(22) Filed: Jan. 28, 2015

(65) Prior Publication Data

US 2015/0225825 A1 Aug. 13, 2015

(30) Foreign Application Priority Data

Feb. 7, 2014 (JP) ..... 2014-021817

(51) Int. Cl.
*C22F 1/047* (2006.01)
*C22C 21/06* (2006.01)
(Continued)

(52) U.S. Cl.
CPC ..... *C22F 1/047* (2013.01); *C22C 21/08* (2013.01); *B22F 9/04* (2013.01)

(58) Field of Classification Search
CPC ..... C22F 1/047; C22C 21/06
See application file for complete search history.

(56) References Cited

U.S. PATENT DOCUMENTS 4,689,090 A 8/1987 Sawtell et al.
4,874,440 A * 10/1989 Sawtell ..... C22F 1/04 148/437

(Continued)

FOREIGN PATENT DOCUMENTS

JP 62-284045 12/1987
JP 2000-271631 10/2000

(Continued)

OTHER PUBLICATIONS

Nieh et al. "High Strain Rate Superplasticity in Continuously Recrystallized Al-8%Mg-0.3%Sc Alloy", Acta Mater. vol. 46, No. 8, pp. 2789-2800, 1998.*

(Continued)

*Primary Examiner* — Lois L Zheng
(74) *Attorney, Agent, or Firm* — Rankin, Hill & Clark LLP

(57) ABSTRACT

An Al alloy cast product includes 3.2% to 7.2% by weight of Mg and 0.28% to 0.6% by weight of Sc, and has an Fe content and an Si content, each of 0.1% by weight or less. The cast product contains, in the metal texture, 3% by volume or less of $Al_3Sc$ particle having a particle diameter of 100 nm or less. In production thereof, an Al alloy melt containing 3.2% to 7.2% by weight of Mg and 0.28% to 0.6% by weight of Sc and having an Fe content and an Si content, each of 0.1% by weight or less, is prepared. Next, a casting formed from the melt is subjected to an aging treatment without a solution heat treatment (or a quenching treatment). Then, 3% by volume or less of $Al_3Sc$ particle having a particle diameter of 100 nm or less is precipitated in the metal texture.

4 Claims, 6 Drawing Sheets

(51) Int. Cl.

| | |
|---|---|
| ***C22C 21/08*** | (2006.01) |
| *C22F 1/00* | (2006.01) |
| *C22C 21/00* | (2006.01) |
| *B22F 9/04* | (2006.01) |

(56) References Cited

U.S. PATENT DOCUMENTS

| | | | | |
|---|---|---|---|---|
| 6,395,111 | B1 | 5/2002 | Pfannenmuller et al. | |
| 2005/0167009 | A1 | 8/2005 | Shoji et al. | |
| 2007/0297936 | A1* | 12/2007 | Ahmad | C22C 21/08 420/541 |
| 2010/0139815 | A1* | 6/2010 | Pandey | C22C 1/0416 148/513 |
| 2010/0319817 | A1* | 12/2010 | Norman | C22C 21/06 148/552 |
| 2011/0044843 | A1 | 2/2011 | Misra et al. | |
| 2011/0164988 | A1 | 7/2011 | Schall et al. | |

FOREIGN PATENT DOCUMENTS

| | | |
|---|---|---|
| JP | 2001-517735 | 10/2001 |
| JP | 4290024 | 4/2009 |
| JP | 2011-510174 | 3/2011 |
| JP | 2012-510017 | 4/2012 |

OTHER PUBLICATIONS

Murashkin et al. "Structure and Mechanical Properties of an Aluminum Alloy 1570 Subjected to Severe Plastic Deformation by High-Pressure Torsion", The Physics of Metals and Metallography, vol. 106, No. 1, pp. 90-96. © Pleiades Publishing, Ltd., 2008.*

Japanese Office Action dated Dec. 26, 2017, with English Translation, 7 pages.

* cited by examiner

FIG. 2

| No. | | COMPONENT COMPOSITION RATIO | | | | | | | $Al_3Sc$ PARTICLE DIAMETER | EVALUATION | | | | |
|---|---|---|---|---|---|---|---|---|---|---|---|---|---|---|
| | | Sc | Mg | Cu | Mn | Cu+Mn | Si | Fe | | CASTING PROPERTY | 0.2% YIELD STRENGTH | HIGH-TEMPERATURE STRENGTH | ELONGATION RATIO | DUCTILITY |
| EX. | 1 | 0.28 | 5 | 0 | 0 | 0 | 0.04 | 0.05 | 30nm> | GOOD | 163 | GOOD | 7.9 | EXCELLENT |
| | 2 | 0.32 | 3.2 | 1.9 | 0 | 1.9 | 0.04 | 0.04 | 〃 | EXCELLENT | 115 | GOOD | 7.7 | EXCELLENT |
| | 3 | 0.32 | 3.4 | 3 | 0 | 3 | 0.04 | 0.05 | 〃 | EXCELLENT | 115 | FAIR | 6.0 | EXCELLENT |
| | 4 | 0.3 | 5.3 | 2.1 | 0 | 2.1 | 0.04 | 0.05 | 〃 | GOOD | 167 | GOOD | 2.5 | GOOD |
| | 5 | 0.3 | 7.2 | 2.1 | 0 | 2.1 | 0.04 | 0.05 | 〃 | GOOD | 133 | GOOD | 3.4 | GOOD |
| | 6 | 0.6 | 5 | 2 | 0 | 2 | 0.05 | 0.04 | 〃 | GOOD | 157 | GOOD | 3.1 | GOOD |
| | 7 | 0.56 | 5 | 0 | 1 | 1 | 0.05 | 0.06 | 〃 | GOOD | 161 | FAIR | 6.2 | EXCELLENT |
| | 8 | 0.57 | 5.1 | 0 | 2 | 2 | 0.05 | 0.07 | 〃 | GOOD | 170 | GOOD | 2.0 | GOOD |
| | 9 | 0.32 | 3.4 | 2.1 | 1 | 3.1 | 0.04 | 0.06 | 〃 | GOOD | 148 | GOOD | 10.5 | EXCELLENT |
| | 10 | 0.32 | 3.5 | 3.2 | 1 | 4.2 | 0.04 | 0.06 | 〃 | EXCELLENT | 143 | GOOD | 9.0 | EXCELLENT |
| | 11 | 0.3 | 5.3 | 1.1 | 1 | 2.1 | 0.04 | 0.06 | 〃 | GOOD | 161 | EXCELLENT | 6.1 | EXCELLENT |
| | 12 | 0.3 | 5.2 | 2.1 | 1 | 3.1 | 0.04 | 0.05 | 〃 | GOOD | 186 | EXCELLENT | 1.2 | FAIR |
| | 13 | 0.57 | 5.4 | 2.3 | 1 | 3.3 | 0.05 | 0.05 | 〃 | GOOD | 173 | EXCELLENT | 1.5 | FAIR |
| | 14 | 0.57 | 5.5 | 2.4 | 1.9 | 4.3 | 0.06 | 0.07 | 〃 | GOOD | 182 | EXCELLENT | 0.6 | FAIR |
| COMP. EX. | 1 | 0.29 | 0.34 | 4.3 | 0 | 4.3 | 2.3 | 0.07 | | EXCELLENT | 95 | POOR | 0.8 | POOR |
| | 2 | 0.61 | 0.283 | 4.03 | 0 | 4.03 | 2.06 | 0.06 | | EXCELLENT | 85 | POOR | 0.7 | POOR |
| | 3 | 0.31 | 0.27 | 8 | 0 | 8 | 1.9 | 0.06 | | FAIR | 105 | POOR | 0.5 | POOR |
| | 4 | 0.62 | 5.3 | 8.1 | 0 | 8.1 | 2.0 | 0.07 | | POOR | 115 | FAIR | 0.3 | POOR |
| | 5 | 0 | 5.3 | 2.2 | 0 | 2.2 | 0.04 | 0.05 | | GOOD | 100 | POOR | 10.2 | EXCELLENT |
| | 6 | 0 | 5.1 | 0 | 0 | 0 | 0.03 | 0.06 | | GOOD | 90 | POOR | 15.5 | EXCELLENT |

ALUMINUM ALLOY CAST PRODUCT AND METHOD FOR PRODUCING THE SAME

CROSS-REFERENCE TO RELATED APPLICATION

This application is based upon and claims the benefit of priority from Japanese Patent Application No. 2014-021817 filed on Feb. 7, 2014, the contents of which are incorporated herein by reference.

BACKGROUND OF THE INVENTION

Field of the Invention

The present invention relates to an Al alloy cast product containing an $Al_3Sc$ precipitation particle in a metal texture thereof, and which exhibits an excellent high-temperature strength, and a method for producing the same.

Description of the Related Art

Aircraft and automobile components are required to have high strength, high heat resistance, and high durability as well as a light weight. Attempts to make such components from Al alloys have been made in view of mass-producing the components at low costs. For example, production of a turbocharger compressor using atomized powder of an Al alloy doped with La and Sc as a starting material is proposed in Japanese Laid-Open Patent Publication No. 2012-510017 (PCT). In this case, the atomized powder is subjected to an HIP (Hot Isostatic Pressing) treatment, and then to an extrusion processing or the like.

In general, this type of component has a complicated shape. In a case where the atomized powder is HIP-treated to produce a sintered body, and then the sintered body is subjected to the extrusion processing in the above manner, the component with a complicated shape cannot be easily produced. Therefore, it is necessary to subject the sintered body to a cutting processing or the like to thereby obtain a final product (the component) with desired shape and size. In addition, also in a case where a powder metallurgy process is carried out using the atomized powder, the component cannot be easily produced with a complicated shape. Therefore, this method does not have a satisfactory production efficiency, and contains a complicated process.

Accordingly, production of the component by casting a melt of an Al alloy has been studied. The casting process is capable of easily producing the component with a complicated shape. Furthermore, the casting process is capable of forming a cast body close in size to the final product. Therefore, this method requires only a simple finish processing such as a burring processing.

Al—Si—Mg alloy (such as AC4CH), Al—Si—Cu—Mg alloy (such as AC4D), and Al—Si—Cu—Mg—Ni alloy (such as AC9A) are known as Al alloys for casting that have relatively excellent high-temperature strengths. The Al—Si—Cu—Mg—Ni alloy (such as AC9A) has a low toughness at ordinary temperature and cannot be easily cast, and therefore is hardly used for the casting process practically.

Among the Al alloys, a particular alloy has been used as a wrought material conventionally, but has been used for producing a cast product in recent years. For example, Japanese Patent No. 4290024 discloses a technology related to a heat-resistant aluminum alloy cast product containing 0.01% to 0.8% of Sc (a thin plaster cast product).

Furthermore, Japanese Laid-Open Patent Publication No. 2011-510174 (PCT) discloses that an Al alloy cast product, which contains an $Al_3(Sc, Zr)$ precipitation particle having a particle diameter of about 40 to 60 μm and a Tr phase deposit having a size of about 5 nm in the metal texture, exhibits an effective resistance to hot tearing.

SUMMARY OF THE INVENTION

Japanese Patent No. 4290024 describes the high-temperature strength only at a temperature of 200° C. or lower. Thus, it is not clear whether the aluminum alloy cast product has a satisfactory strength at a temperature of higher than 200° C. Furthermore, a solution heat treatment is required to obtain the high-temperature strength. In addition, this document does not describe the elongation ratio of the aluminum alloy cast product that is required for the aircraft and automobile components. Furthermore, it is not clear what elongation ratio of the aluminum alloy cast product is.

The Al alloy cast product described in Japanese Laid-Open Patent Publication No. 2011-510174 (PCT) is produced under a significantly high cooling rate of 100° C./second or more. However, in general, it is difficult to achieve the same properties in a sand or metal mold casting process. Furthermore, in the case of using the casting, which is formed by using the Al alloy as a starting material, for producing the aircraft and automobile components, it is necessary to subject the casting to a cutting processing or the like to thereby obtain a final product with desired shape and size. Thus, the complicated shape cannot be easily obtained.

Consequently, there is a demand for a technology capable of producing an Al alloy cast product with a more complicated shape, a more excellent strength, a more excellent toughness, etc. as compared with the technologies described in Japanese Patent No. 4290024 and Japanese Laid-Open Patent Publication No. 2011-510174 (PCT).

The present invention has been made to solve the above problems, and an object of the present invention is to provide an Al alloy cast product having excellent properties, such as a good casting property and an excellent high-temperature strength, and a method for producing such an Al alloy cast product.

In view of achieving the above object, an Al alloy cast product according to the present invention includes 3.2% to 7.2% by weight of Mg and 0.28% to 0.6% by weight of Sc, wherein the Al alloy cast product has an Fe content and an Si content, each of 0.1% by weight or less, and contains in the metal texture 3% by volume or less of $Al_3Sc$ particle having a particle diameter of 100 nm or less.

When the particle diameter is more than 100 nm, a precipitation effect of the $Al_3Sc$ particle is reduced. Thus, it is difficult to improve the strength of the Al alloy cast product. Meanwhile, when more than 3% by volume of the $Al_3Sc$ particle is generated, the $Al_3Sc$ has to be in the state of a supersaturated solid solution, so that a significantly high cooling rate is required, and such a process is difficult to carry out practically. Furthermore, in this case, a huge cost is required for the process.

The Al alloy cast product, obtained from an Al alloy melt having the above component composition, has only a small number of cast defects. Thus, the Al alloy has an excellent casting property. In addition, the Al alloy cast product is excellent in strength (particularly high-temperature strength) due to the fine $Al_3Sc$ particle in the metal texture.

The Al alloy cast product may further include at least one of Cu and Mn. Owing to the presence of such elements, the strength of the Al alloy cast product can be further improved. The total ratio of Cu and Mn is set to be at most 4.3% by weight.

Typically, the Al alloy cast product has an elongation ratio of 1% to 10% at an ordinary temperature, and exhibits a 0.2% yield stress of 100 to 190 MPa in a high-temperature tensile test at 250° C. after exposed to a temperature of 200° C. to 250° C. for 100 hours.

A method for producing an Al alloy cast product according to the present invention includes the steps of:

preparing an Al alloy melt containing 3.2% to 7.2% by weight of Mg, 0.28% to 0.6% by weight of Sc, and an Fe content and an Si content, each of 0.1% by weight or less;

obtaining a casting from the melt; and subjecting the casting to an aging treatment without a solution heat treatment, to precipitate, in a metal texture of the Al alloy cast product, 3% by volume or less of $Al_3Sc$ particle having a particle diameter of 100 nm or less.

This method is capable of producing the Al alloy cast product excellent in casting property and strength (particularly high-temperature strength). This is considered to be because the casting is subjected to the aging treatment without carrying out the solution heat treatment (or a quenching treatment), whereby the $Al_3Sc$ particle has a significantly small particle diameter of 100 nm or less.

The aging treatment, for example, may be carried out at a temperature of 250° C. to 350° C. for 5 to 100 hours.

The Al alloy melt may further contain at most 4.3% by weight of at least one of Cu and Mn. In this case, the strength of the Al alloy cast product can be further improved as described above.

As described above, in the present invention, the Al alloy cast product has a component composition ratio within a predetermined range, and contains 3% by volume or less of the $Al_3Sc$ particle having a particle diameter of 100 nm or less in the metal texture. Consequently, the Al alloy cast product excellent in the casting property and the strength (particularly the high-temperature strength) can be produced at a high yield.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 2 is a table showing component composition ratios and test results in test pieces of Examples 1 to 14 and Comparative Examples 1 to 6;

DESCRIPTION OF THE PREFERRED EMBODIMENTS

A preferred embodiment of the Al alloy cast product and the production method of the present invention will be described in detail below with reference to the accompanying drawings.

First, an Al alloy cast product according to this embodiment will be described below. The Al alloy cast product contains at least 3.2% to 7.2% by weight of Mg and 0.28% to 0.6% by weight of Sc, and has an Fe content of 0.1% by weight or less and an Si content of 0.1% by weight or less.

Mg is a component for providing the strength of the Al alloy cast product. When the Mg content is less than 3.2% by weight, the Al alloy cast product does not have a sufficient strength. On the other hand, when the Mg content is more than 7.2% by weight, the casting property is deteriorated, and the Al alloy cast product consequently has cast defects.

Sc is a component for generating an $Al_3Sc$ particle together with Al. When the $Al_3Sc$ particle is present in the metal texture, the Al alloy cast product can be excellent in the strength (particularly high-temperature strength). Furthermore, the $Al_3Sc$ particle acts to form a fine solidified structure and to improve the running property.

The Sc content is set at 0.28% to 0.6% by weight as described above. When the Sc content is less than 0.28% by weight, the precipitation amount of the $Al_3Sc$ particle is reduced, thereby failing to achieve the strength improvement. On the other hand, when the Sc content is more than 0.6% by weight, the $Al_3Sc$ precipitation particle is made coarse and does not act to improve the strength. As a result, the Al alloy cast product does not exhibit a sufficient strength.

Figure 1:
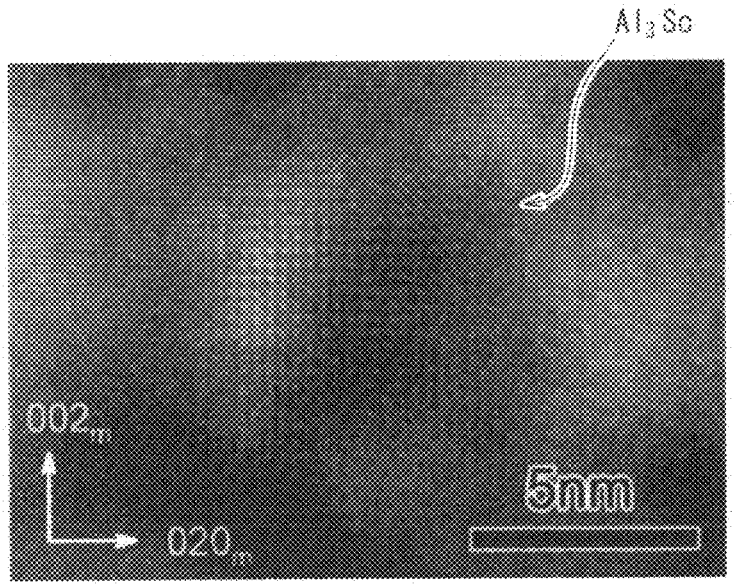
FIG. 1 is a transmission electron microscope photograph of an Al alloy cast product according to an embodiment of the present invention.

FIG. 1 is a transmission electron microscope (TEM) photograph of the Al alloy cast product. As is clear from FIG. 1, the $Al_3Sc$ particle having a particle diameter of 100 nm or less, typically 5 to 10 nm, is observed to be contained in the metal texture. The identification of the $Al_3Sc$ particle can be made by an energy dispersive X-ray spectroscopy analysis (EDS).

It is also clear from FIG. 1 that the volume ratio of the $Al_3Sc$ particle is 3% by volume or less. Thus, the Al alloy cast product of this embodiment contains 3% by volume or less of the $Al_3Sc$ particle having a particle diameter of 100 nm or less in the metal texture.

In general, Al alloys contain Fe and Si as unavoidable impurities. In the Al alloy cast product of this embodiment, the Fe content and the Si content are each set to be 0.1% by weight or less.

Thus, in this embodiment, the Fe and Si contents are reduced as much as possible. In particular, the inventor has found that Si has an influence on the strength and the casting property of the Al alloy cast product. Therefore, by reducing the Si content as much as possible, the high-temperature strength of the Al alloy cast product can be particularly improved. Furthermore, by reducing the Fe content as much as possible, the ductility at room temperature and the casting property of the Al alloy cast product can be improved.

The Al alloy cast product may further contain at least one of Cu and Mn, whereby the strength of the Al alloy cast product can be advantageously improved.

In this case, the total ratio of the elements Cu and Mn is set to be at most 4.3% by weight in order to prevent the deterioration of the casting property in the casting process and the deterioration of the ductility in the product. Thus, regardless of whether the Al alloy cast product contains only Cu, only Mn, or both of Cu and Mn, the ratio of the total of added Cu and Mn is at most 4.3% by weight.

The Al alloy cast product, which contains the above elements within the above ratio ranges and contains the $Al_3Sc$ particle in the metal texture, can exhibit various excellent properties (particularly the excellent high-temperature strength). Thus, typically, the Al alloy cast product has an elongation ratio of 1% to 10% at an ordinary temperature, and has a 0.2% yield stress of 100 to 190 MPa at 250° C.

Next, a method for producing the above Al alloy cast product will be described below.

First, a pure Al material or an Al alloy material to be melted is prepared. The pure Al and Al alloy materials may be mixed such that the resultant has an Mg content of 3.2% to 7.2% by weight, an Sc content of 0.28% to 0.6% by weight, an Fe content of 0.1% by weight or less, and an Si content of 0.1% by weight or less. Thus, for example, in the case of using an Al alloy material containing 7.5% by weight of Mg, the Mg content may be lowered to be within the range between 3.2% and 7.2% by mixing with an Al alloy material having a lower Mg ratio or a pure Al material.

The Al alloy material may contain at least one of Cu and Mn. In this case, the total ratio of Cu and Mn is set to be at most 4.3% by weight as described above.

The pure Al material, the Al alloy material, the doping element source, and the like may be in the form of a powder. For example, a pure Al powder, a pure Mg powder, a pure Sc powder, a pure Cu powder, and a pure Mn powder may be added and mixed such that the resultant contains 3.2% to 7.2% by weight of the pure Mg powder, 0.28% to 0.6% by weight of the pure Sc powder, 4.3% by weight or less of the pure Cu powder 1 and the pure Mn powder in total, and the balance of the pure Al powder. In this case, because the pure metal powders are used, the ratios of the unavoidable impurities Si and Fe can be 0.1% by weight or less.

Then, the pure Al material or the Al alloy material is melted to obtain a melt. Of course, for example, another Al alloy material may be added to a melt of an Al alloy material.

Next, the melt is introduced into a mold of a casting apparatus. The melt is cooled and solidified into a shape corresponding to a cavity shape of the mold, whereby a casting of the Al alloy is obtained.

In thus-obtained Al alloy casting, the Mg ratio and the Sc ratio are controlled within the above predetermined ranges. Furthermore, in a case where the casting contains Cu and Mn, the maximum value of the total ratio of Cu and Mn is set at the above predetermined value. Thus, the excellent casting property can be achieved, whereby the Al alloy casting can be obtained while preventing generation of cast defects.

In general, such an Al alloy casting is subjected to a solution heat treatment to form a homogeneous solid solution, and then is subjected to a quenching treatment (a rapid cooling treatment). In known conventional technologies, the casting is further subjected to an aging treatment to generate a precipitate in the metal texture.

In contrast, in this embodiment, the solution heat treatment and the quenching treatment are not carried out. Thus, the Al alloy casting, obtained by cooling and solidifying the melt, is subjected to the aging treatment, which is the next step, without the solution heat treatment or the quenching treatment.

When the aging treatment is carried out without the solution heat treatment or the quenching treatment, the fine $Al_3Sc$ particle having a particle diameter of 100 nm or less is precipitated in the metal texture. The ratio of the area (volume) occupied by the $Al_3Sc$ particle in the metal texture can be determined by an electrical resistance method using a standard curve, which is obtained from the relationship between the amount of the $Al_3Sc$ particle occupying the Al alloy cast product and the resistance value of the Al alloy cast product. The $Al_3Sc$ particle occupation area (volume) ratio determined in this manner is 3% by volume or less.

The aging treatment may be carried out under conditions suitable for generating the $Al_3Sc$ particle in the above manner. For example, in the aging treatment, the Al alloy casting is preferably maintained at a temperature of 250° C. to 350° C. for 5 to 100 hours, however the temperature and time are not particularly limited to the above.

Then, the resultant Al alloy cast product may be cooled to a room temperature. The Al alloy cast product containing the $Al_3Sc$ precipitation particle in the metal texture can be produced in the above manner.

The Al alloy cast product may be subjected to a finish processing such as a burring processing if necessary. The final product having desired shape and size can be obtained in this manner. The final product (the Al alloy cast product) can be used, for example, as an aircraft or automobile component because it has the excellent properties such as the high strength as described above.

The casting process is capable of easily producing a component with a complicated shape. Thus, the method of the present embodiment is capable of efficiency producing a complicated-shaped product with the excellent properties such as the high strength.

Though the Al alloy cast product is produced with a desired predetermined shape in the example of the above embodiment, it may have a plate shape, a rod shape, etc. The plate- or rod-shaped Al alloy cast product may be subjected to a forge processing, and a product (forging) having a predetermined shape may be produced by using the Al alloy cast product as a starting material.

Since the forging is produced by processing the starting material of the Al alloy cast product, also the forging exhibits various excellent properties.

First Example

Pure Al, pure Mg, pure Sc, pure Cu, and pure Mn were mixed at each of the ratios shown in FIG. 2. Each material may be in the form of a powder, an ingot, or a particle, as long as each material has Si and Fe contents of 0.1% by weight or less. Of course, the Mg content was controlled within the range of 3.2% to 7.2% by weight, and the Sc content was controlled within the range of 0.28% to 0.6% by weight. In the case of adding Cu and Mn, the total ratio of Cu and Mn was controlled at 4.3% by weight at most.

Each of the powder mixtures was melted to prepare a melt, and the melt was cast to produce an Al alloy test piece. More specifically, a plurality of test pieces for each of Examples 1 to 14 were produced in this manner. The test pieces for each example had the same component composition ratio but different shapes, which were appropriate for respective tests to be hereinafter described. Each test piece was subjected to an aging treatment immediately after cooled to a predetermined temperature.

The metal textures of the test pieces were observed using a TEM or the like. As a result, it was confirmed that the metal textures each contained 1% by volume or less of a particle with a diameter of 30 nm or less. Furthermore, the particles were identified by EDS. As a result, the particles were confirmed to be composed of $Al_3Sc$.

For comparison, Al alloy test pieces having the same component composition ratios as those of Examples 1, 4, and 12 were prepared respectively, and were subjected to a solution heat treatment, a quenching treatment, and the aging treatment. In this case, it was confirmed that generated $Al_3Sc$ particles each had a diameter of more than 30 nm, and the $Al_3Sc$ particles were thus made coarse.

Figure 3:
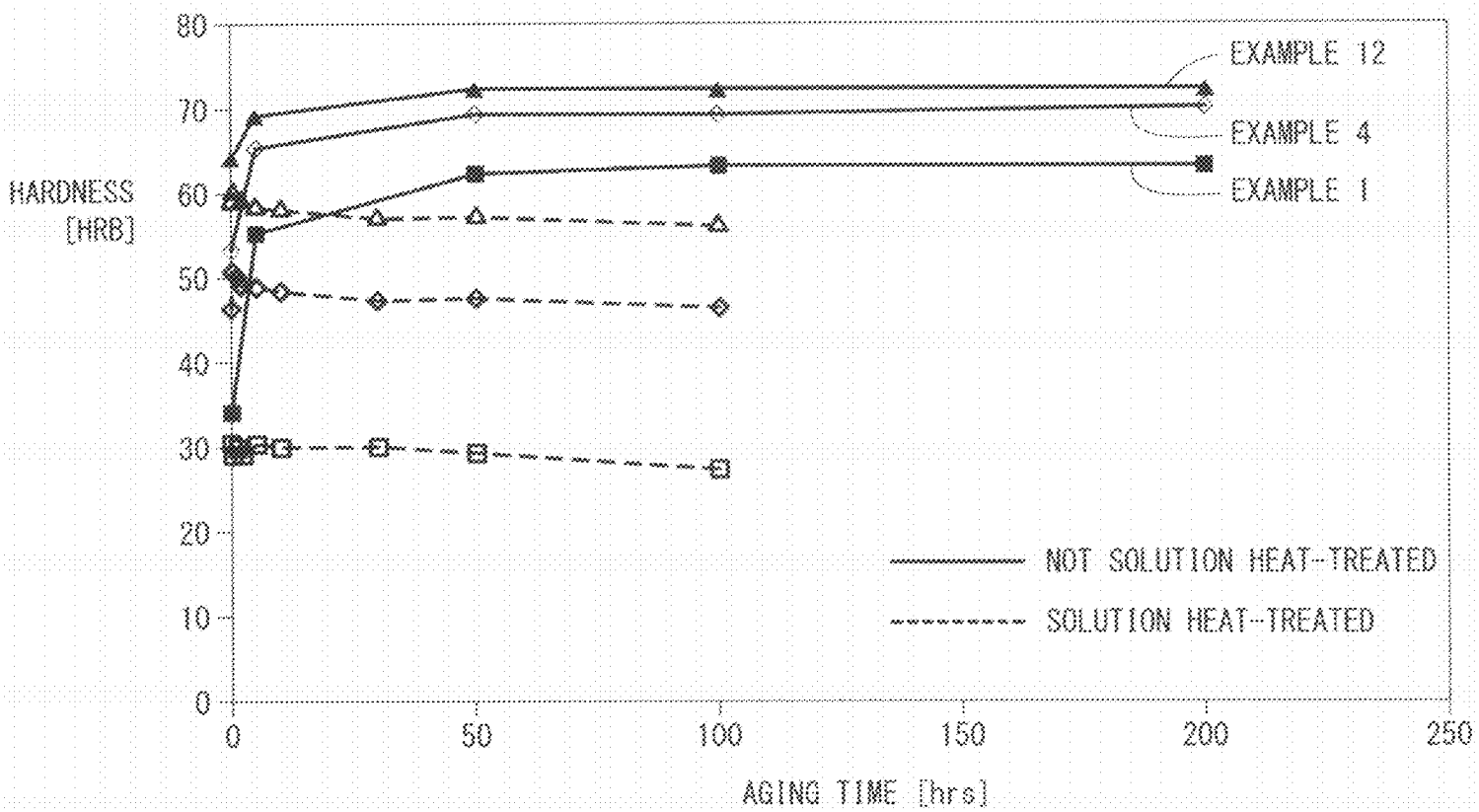
FIG. 3 is a graph showing the relationships between retention times in the aging treatment and B-scale Rockwell hardnesses in test pieces that are subjected to an aging treatment without carrying out a solution heat treatment or a quenching treatment, and test pieces that are subjected to the solution heat treatment, the quenching treatment, and the aging treatment.

FIG. 3 is a graph showing the relationships between retention times in the aging treatment and B-scale Rockwell hardnesses in the test pieces that were subjected to the aging treatment without carrying out the solution heat treatment or the quenching treatment, and the test pieces that were subjected to the solution heat treatment, the quenching treatment, and the aging treatment. In FIG. 3, the results of the former test pieces are represented by solid lines, and the results of the latter test pieces are represented by dashed lines. The plots of square shapes (black and white), diamond shapes (black and white), and triangular shapes (black and white) correspond to the component composition ratios of Examples 1, 4, and 12 respectively.

As is clear from FIG. 3, the former test pieces, subjected to the aging treatment without carrying out the solution heat treatment or the quenching treatment, had higher hardnesses. A material having a higher hardness exhibits a higher strength, and accordingly the former test pieces had higher strengths. The hardness (strength) difference is considered to be caused due to smaller $Al_3Sc$ particle diameters of the former test pieces.

A plurality of test pieces for each of Comparative Examples 1 to 4 having an Si content of 1.9% by weight or more were produced by the casting process, and furthermore a plurality of test pieces for each of Comparative Examples 5 and 6 without any Sc being added were produced by the casting process. Each test piece was subjected to the aging treatment after cooled to the predetermined temperature in the same manner as above. Also the component composition ratios of the test pieces of Comparative Examples 1 to 6 are shown in FIG. 2.

Figure 4:
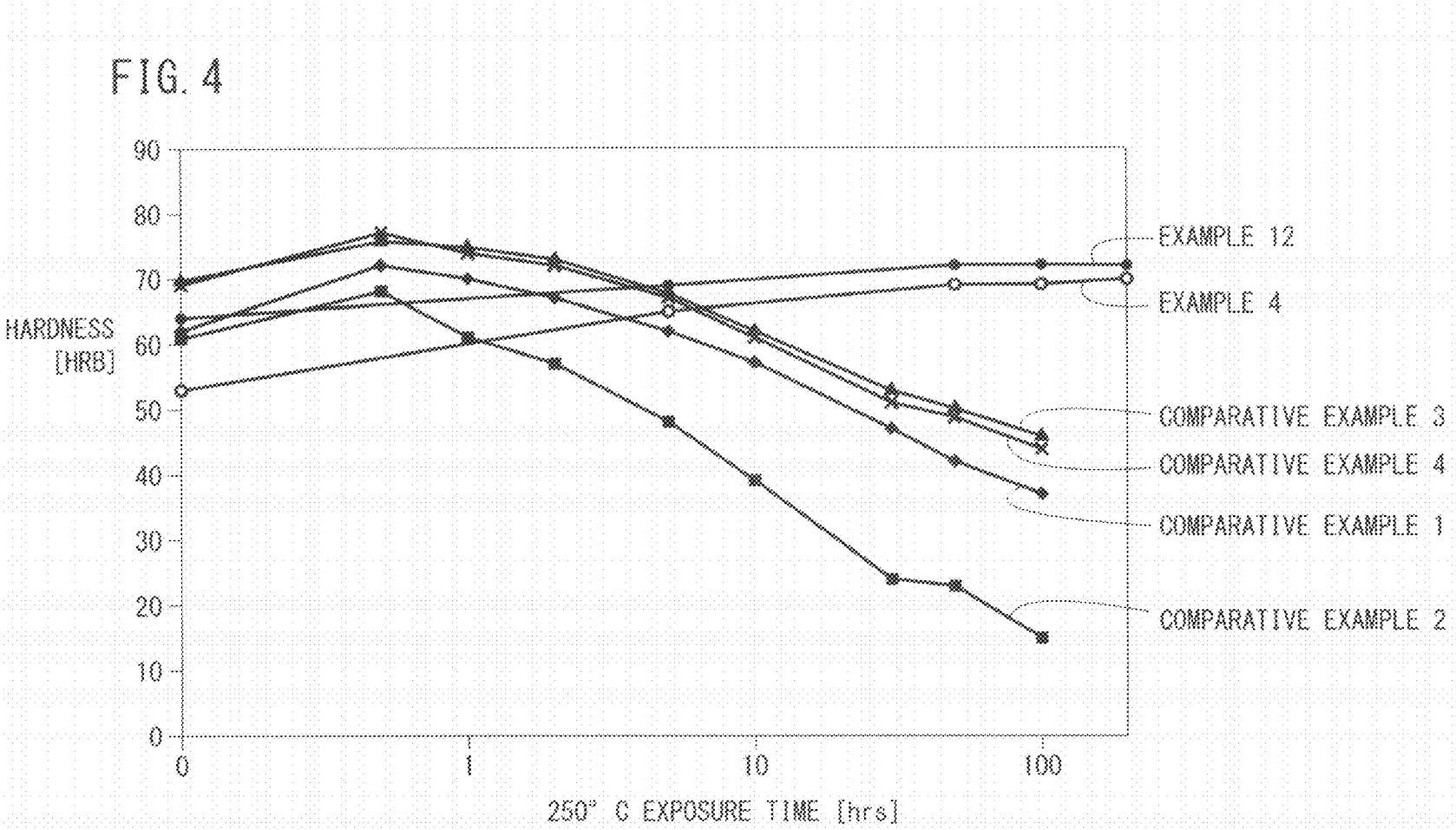
FIG. 4 is a graph showing the relationships between retention times in the aging treatment and B-scale Rockwell hardnesses in the test pieces of Examples 4 and 12 and Comparative Examples 1 to 4.

FIG. 4 is a graph showing the relationships between the retention times in the aging treatment (exposure to 250° C.) and the B-scale Rockwell hardnesses in the test pieces of Examples 4 and 12 and Comparative Examples 1 to 4. As is clear from FIG. 4, in the test pieces of Comparative Examples 1 to 4, which have higher Si contents, the longer the retention time is, the lower the hardness becomes. In other words, the test pieces of Comparative Examples 1 to 4 did not have sufficient high-temperature strengths. In contrast, in the test pieces of Examples 4 and 12, the hardness increased with the retention time. Thus, the test pieces of Examples 4 and 12 had sufficient high-temperature strengths.

The casting properties of the test pieces of Examples 1 to 14 and Comparative Examples 1 to 6 were evaluated. Also the results are shown in FIG. 2. "Excellent" and "Good" in the casting property mean that the test piece has only a small number of cast defects.

Si is known to be capable of improving the casting property. However, the test pieces of Examples 1 to 14 exhibited excellent casting properties even though they had significantly low Si contents.

Each of the test pieces of Examples 1 to 14 and Comparative Examples 1 to 6 was exposed to a temperature of 200° C. to 250° C. for 100 hours, and then the 0.2% yield strength was measured. The results of the test pieces are shown in FIG. 2. When the test piece had a satisfactory 0.2% yield strength after exposed to the temperature of 200° C. to 250° C. for 100 hours, the durability of the test piece was able to be judged as being hardly deteriorated.

A tensile test was carried out within a temperature range of 150° C. to 250° C., and then the evaluation was made by comparison with an AC4D material. The evaluation criterion was as follows: when a test piece had a higher strength than the AC4D material over the entire temperature range, the test piece was evaluated as "Excellent"; when a test piece had a strength equivalent to the AC4D material at approximately 150° C. and had a higher strength than the AC4D material at 250° C., it was evaluated as "Good"; when a test piece had a slightly lower strength than the AC4D material at approximately 150° C. and had a higher strength than the AC4D material at 250° C., it was evaluated as "Fair"; and when a test piece had a lower strength than the AC4D material over the entire temperature range, it was evaluated as "Poor". Also the results are shown in FIG. 2.

As is clear from FIG. 2, the test pieces of Examples 1 to 14 had sufficiently high strengths at 200° C. to 250° C. (sufficiently high high-temperature strengths) even after the exposure for 100 hours.

The elongation ratio of each test piece was measured at the room temperature, and was evaluated by comparison with that of the AC4D material. Incidentally, the AC4D material had an elongation ratio of about 2%. The evaluation criterion was as follows: when a test piece had an elongation ratio of 4% or more, the test piece was evaluated as "Excellent"; when a test piece had an elongation ratio of 2% to 4%, it was evaluated as "Good"; and when a test piece had an elongation ratio of 1% to 2%, it was evaluated as "Fair". Also the results are shown in FIG. 2. The test pieces of Comparative Examples 1 to 4 were broken before the elongation ratio reached 1%.

As is clear from FIG. 2, the test pieces of Examples 1 to 14 had satisfactory elongation ratios.

Second Example

Figure 5:
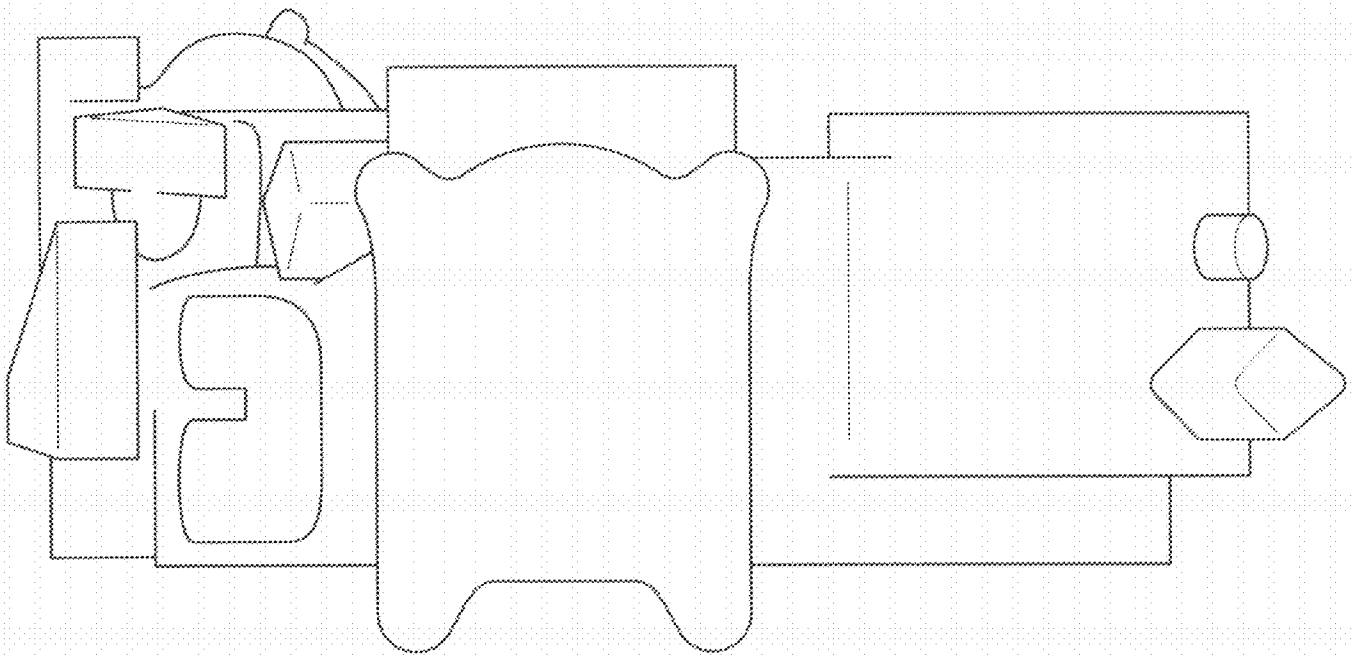
FIG. 5 is an overall schematic front view of a sand mold used in a casting process.

Each of the Al alloy of Example 12, an AC4D material, and an AC9A material was cast into a gearbox by using a sand mold 10 shown in FIG. 5. In Example 12, even a portion having a thickness of 3 to 20 mm was able to be cast with an excellent running property.

Figure 6:
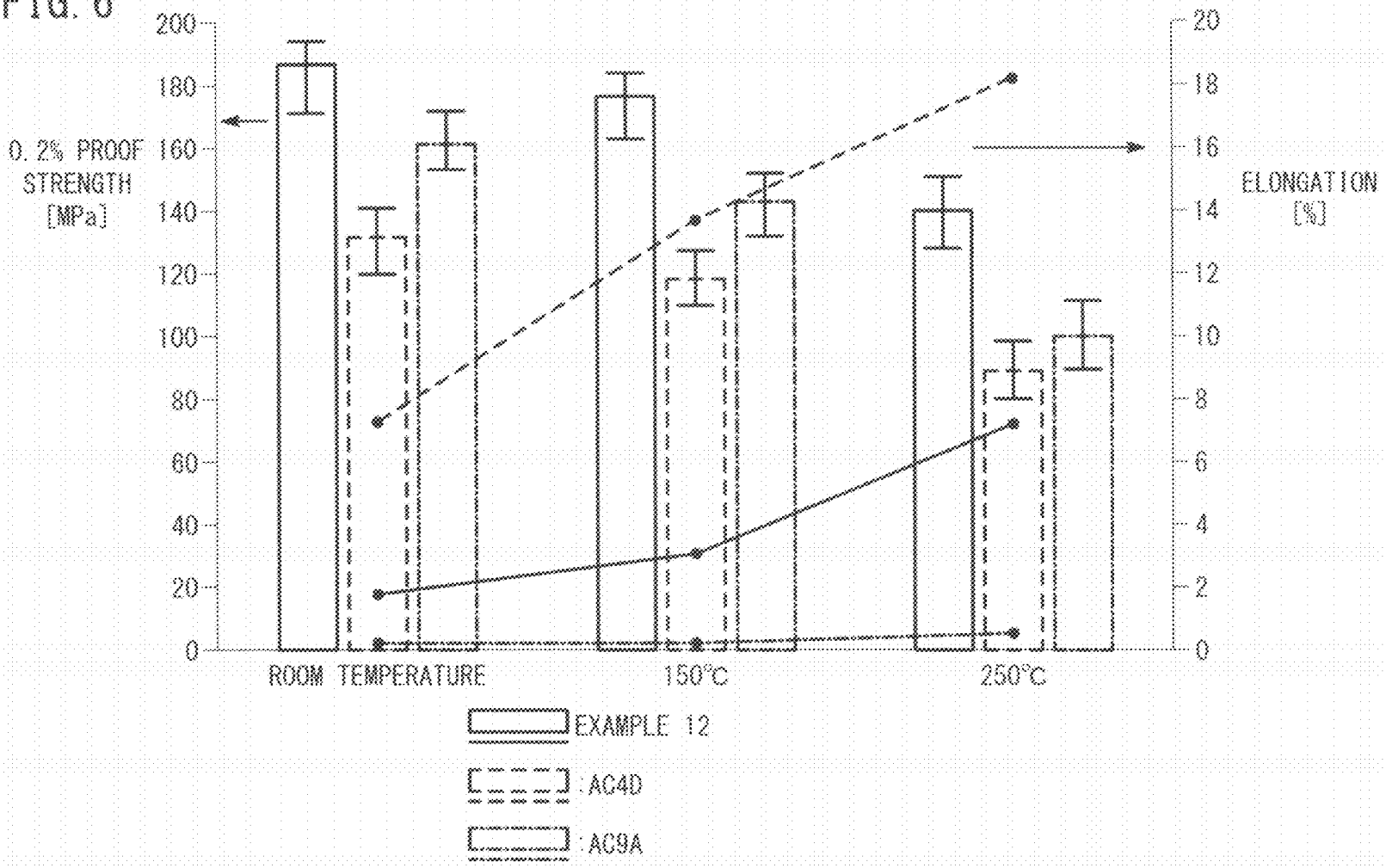
FIG. 6 is a graph showing the tensile test results in test pieces cut from cast products of an Al alloy of Example 12, an AC4D material, and an AC9A material.

A test piece was cut from each cast product. Of the test pieces, Example 12 and the AC4D material were exposed to a temperature of 250° C. for 100 hours before test. On the other hand, the AC9A material was not subjected to the exposure. Then, the test pieces were subjected to a tensile test at the room temperature, 150° C., and 250° C. respectively. The results are shown in FIG. 6. In FIG. 6, the bar graph represents the 0.2% proof strength, and the line graph represents the elongation.

The test piece of Example 12 had a high room-temperature strength and a high high-temperature strength, and further had a sufficient ductility suitable for the gearbox. Although the test piece of the AC4D material had a sufficient ductility, a crystallized Si was observed within the AC4D test piece at the breakage starting point. The ductility may be deteriorated due to the crystallized Si. In contrast, the test piece of Example 12 did not contain such a coarse crystal, so that the strength and ductility were maintained. The test piece of the AC9A material exhibited the lowest ductility.

The present invention is not limited to the embodiment described above, and various changes and modifications may be made to the embodiment without departing from the scope of the invention as set forth in the appended claims.

What is claimed is:

1. An Al alloy cast product comprising 3.2% to 7.2% by weight of Mg, 0.28% to 0.6% by weight of Sc, and 3.1% to 4.3% by weight of at least one of Cu and Mn, wherein the Al alloy cast product has an Fe content and an Si content as unavoidable impurities, with the Fe content being 0.07% by weight or less and the Si content being 0.06% by weight or less, and contains, in a metal texture of the Al alloy cast product, 3% by volume or less of $Al_3Sc$ particle having a particle diameter of 5 to 10 nm.

2. The Al alloy cast product according to claim 1, wherein the Al alloy cast product has an elongation ratio of 1% to 10% at an ordinary temperature, and has a 0.2% yield stress of 100 to 190 MPa after exposed to a temperature of 200° C. to 250° C. for 100 hours.

3. An Al alloy cast product comprising Mg, Sc, Mn, and Cu and having 3.2% to 7.2% by weight of Mg, 0.28% to 0.6% by weight of Sc, 1.0% to 2.0% by weight of Mn, and at most 4.3% by weight of Cu and Mn with 2.1% to 3.2% by weight of Cu, wherein the Al alloy cast product has an Fe content and an Si content as unavoidable impurities, each of 0.1% by weight or less, and contains, in a metal texture of the Al alloy cast product, 3% by volume or less of $Al_3Sc$ particle having a particle diameter of 100 nm or less.

4. The Al alloy cast product according to claim 3, wherein the $Al_3Sc$ particle has a particle diameter of 30 to 100 nm.

* * * * *